US011210981B2

(12) United States Patent
Humphries et al.

(10) Patent No.: US 11,210,981 B2
(45) Date of Patent: Dec. 28, 2021

(54) METHOD FOR OPERATING AN IMAGE GENERATOR, AN IMAGE GENERATOR, A METHOD FOR GENERATING DIGITAL COLOUR IMAGE DATA AND A DISPLAY SYSTEM

(71) Applicant: BAE SYSTEMS plc, London (GB)

(72) Inventors: David Richard Humphries, Rochester (GB); David Frederick Henry Ward, Rochester (GB); Ian Gray Rigge, Rochester (GB)

(73) Assignee: BAE SYSTEMS PLC, London (GB)

( * ) Notice: Subject to any disclaimer, the term of this patent is extended or adjusted under 35 U.S.C. 154(b) by 86 days.

(21) Appl. No.: 16/754,584

(22) PCT Filed: Oct. 12, 2018

(86) PCT No.: PCT/GB2018/052926
§ 371 (c)(1),
(2) Date: Apr. 8, 2020

(87) PCT Pub. No.: WO2019/081885
PCT Pub. Date: May 2, 2019

(65) Prior Publication Data

US 2020/0258435 A1 Aug. 13, 2020

(30) Foreign Application Priority Data

Oct. 23, 2017 (EP) ..... 17275170
Oct. 23, 2017 (GB) ..... 1717403

(51) Int. Cl.
*G09G 3/02* (2006.01)

(52) U.S. Cl.
CPC ..... *G09G 3/02* (2013.01); *G09G 2380/12* (2013.01)

(58) Field of Classification Search
CPC .. G09G 1/06–14; G09G 3/02; G09G 2380/12; G06F 3/1475
See application file for complete search history.

(56) References Cited

U.S. PATENT DOCUMENTS 4,200,866 A 4/1980 Strathman
4,419,689 A 12/1983 Russell et al.
(Continued)

FOREIGN PATENT DOCUMENTS

EP 1092217 B1 9/2005
WO 2019081885 A1 5/2019

OTHER PUBLICATIONS

International Search Report and Written Opinion received for PCT Application No. PCT/GB2018/052926, dated Jan. 11, 2019. 16 pages.
(Continued)

*Primary Examiner* — Priyank J Shah
(74) *Attorney, Agent, or Firm* — Finch & Maloney PLLC

(57) ABSTRACT

A method is provided for operating an image generator, arranged to generate and to output signals for displaying image elements of a predefined set of image elements, each image element being defined by respective varying deflection signals. A colour change trigger is firstly defined comprising an additional image element defined by varying deflection signals different to varying deflection signals of an image element of the predefined set. Varying deflection signals of the defined colour change trigger are generated and output thereby to indicate a respective colour for use in displaying an image element of the predefined set.
An image generator is also provided, configured to implement the method. A method is also provided for generating digital colour image data from signals output by such an image generator. A display system is also provided incor-
(Continued)

porating such an image generator together with a colour change trigger detector and scan converter.

20 Claims, 5 Drawing Sheets

(56) References Cited

U.S. PATENT DOCUMENTS

| | | | |
|---|---|---|---|
| 6,671,406 | B1 | 12/2003 | Anderson |
| 2001/0024521 | A1 | 9/2001 | Anderson |
| 2010/0271550 | A1 | 10/2010 | Jardee et al. |

OTHER PUBLICATIONS

GB Search Report under Section 17(5) received for GB Application No. 1717403.8 dated Apr. 19, 2018. 4 pages.
Extended European Search Report received for EP Application No. 17275170.3, dated Mar. 12, 2018. 10 pages.
International Preliminary Report on Patentability received for PCT Application No. PCT/GB2018/052926, dated May 7, 2020 11 pages.

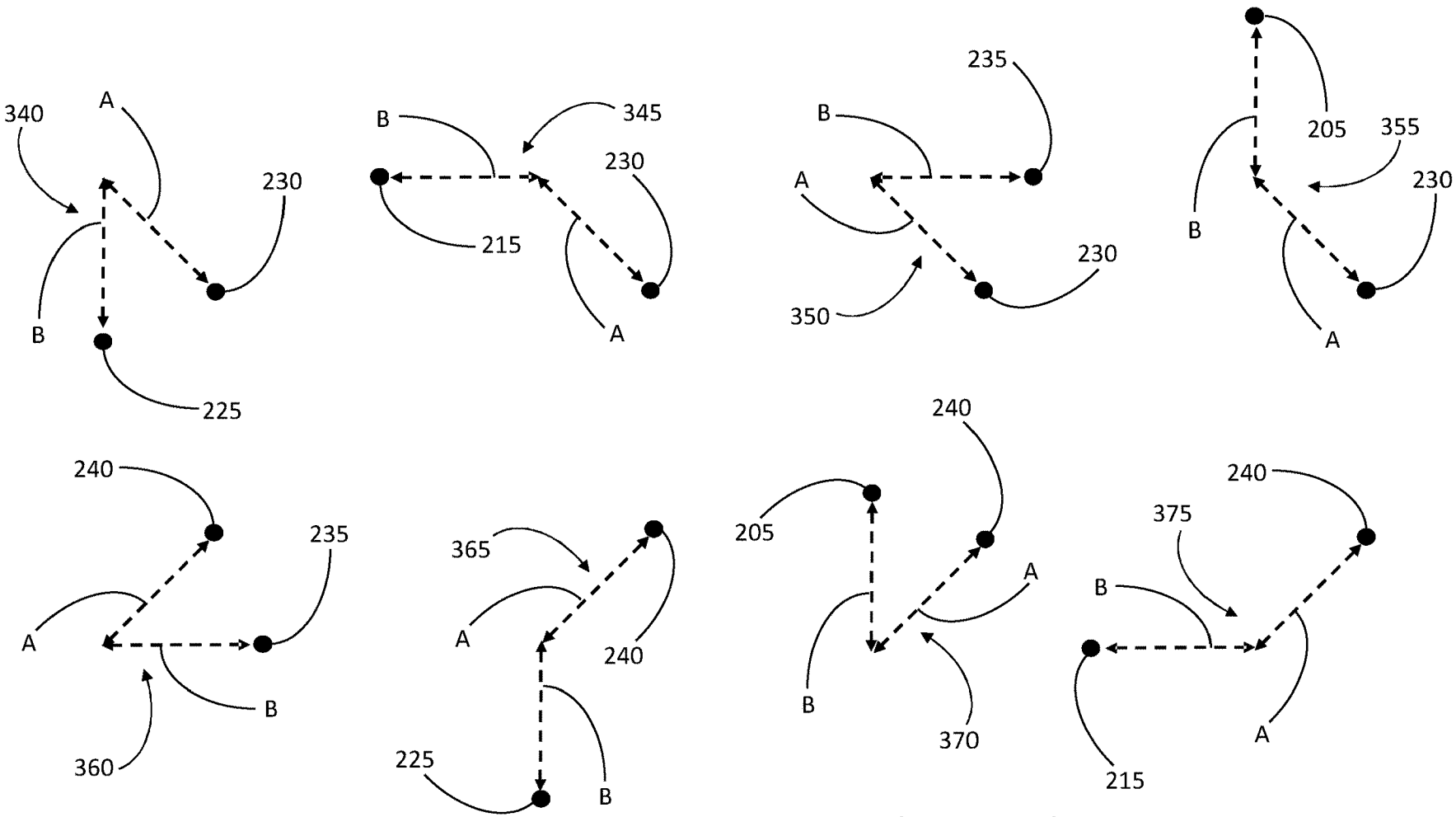
Figure 3b (contd.)

METHOD FOR OPERATING AN IMAGE GENERATOR, AN IMAGE GENERATOR, A METHOD FOR GENERATING DIGITAL COLOUR IMAGE DATA AND A DISPLAY SYSTEM

TECHNICAL FIELD

This invention relates to a method for operating an image generator, to an image generator configured to operate the method, to a display system incorporating such an image generator and to a method for generating digital colour image data for a digital display using output by an image generator operated according to the method.

BACKGROUND

Display systems for avionic applications, in particular, tend to have a long lifetime, often linked to an expected lifetime of the platform in which they are intended to operate. Equipment in such display systems is designed to operate with a high level of reliability and is consequently expensive. It is therefore desirable to be able to benefit from advances in display technology without necessarily replacing an entire display system.

SUMMARY OF THE INVENTION

According to a first aspect disclosed herein, there is provided a method for operating an image generator, arranged to generate and to output signals for displaying image elements of a predefined set of image elements, each image element being defined by respective varying deflection signals, the method comprising:

defining a colour change trigger, comprising an additional image element defined by varying deflection signals different to varying deflection signals of an image element of the predefined set; and generating and outputting the varying deflection signals of the defined colour change trigger thereby to indicate a respective colour for use in displaying an image element of the predefined set.

Digital display devices such as digital micro-mirror devices (DMDs) or liquid crystal over silicon (LCoS) devices offer significant advantages over CRT-based display devices in their size, weight and power consumption. Implementation of the method according to this first aspect of the present invention enables an image generator for a traditional CRT-based display system to be used to control a digital display to generate colour symbols while continuing to operate with traditional CRT-based helmet-mounted displays if required.

In an example of the method, the varying deflection signals defining the colour change trigger image element comprise an initial sequence of varying deflection signals followed by signals representing a combination of at least a first set of return deflections along a first direction and a second set of return deflections along a second direction, different to the first direction. Output of a distinct initial sequence enables a colour change trigger (CCT) to be more easily detected by a receiver.

In an example, the initial sequence of varying deflection signals represent deflections between a start position and a second position including three changes of direction each of approximately 180°. Such a combination of deflections is not expected to be used during the display of image elements in the predefined set and therefore represents a unique indicator of a CCT symbol.

In an example, the method comprises outputting a signal to indicate that the colour change trigger image element is not to be displayed. This enables continuing compatibility of the image generator with CRT-based displays.

In an example, the method comprises outputting varying deflection signals representing a colour change trigger image element before outputting varying deflection signals representing an image element of the predefined set thereby to indicate that the image element of the predefined set is to be displayed with the colour indicated by the preceding colour change trigger image element. Optionally, according to an implementation of the method, further image elements defined by signals output by the image generator may be displayed with the same indicated colour until a new CCT symbol is output by the image generator.

In an example, the method comprises defining a plurality of colour change trigger image elements, each represented by different varying deflection signals and each indicating a different colour in a predefined palette of colours.

In an example, each of the plurality of colour change trigger image elements is arranged such that the time period required for the signal generator to output the varying deflection signals for each of the plurality of colour change trigger image elements is the same. This simplifies the detection of CCT symbols in that the timing of variations in deflection direction represented in received signals may be predicted and a CCT symbol recognition process may be synchronised to the expected timing of such variations in deflection direction.

In an example implementation, the varying deflection signals comprise varying x and y-direction deflection voltages.

According to a second aspect disclosed herein, there is provided a method for generating digital colour image data for a digital display using output by an image generator operated according to the method described above according to the first aspect disclosed herein, comprising:

(i) receiving varying deflection signals output by the image generator;

(ii) determining the deflection directions represented by the received varying deflection signals;

(iii) recognising, from selected combinations of the determined deflection directions, a respective colour change trigger, thereby to determine a colour indicated by the recognised colour change trigger; and (iv) converting the received varying deflection signals into image data defining pixels in a digital display device for displaying a respective image element with the indicated colour.

In an example of the method according to this second aspect, at (iii), the selected combination of determined deflection directions comprise pairs of deflection directions determined at times separated by an expected time to receive varying deflection signals defining one component of a colour change trigger.

According to a third aspect disclosed herein, there is provided a display system comprising:

an image generator configured to operate according to the method as described above according to the first aspect disclosed herein;

a colour change trigger detector configured to determine deflection directions represented by varying deflection signals received from the image generator and, using selected combinations of the determined deflection directions, to recognise a respective colour change trigger thereby to determine a colour indicated by the recognised colour change trigger; and a scan converter configured to convert varying deflection signals received from the image generator into image data defining pixels in a digital display device for displaying a respective image element with the indicated colour.

In an example according to this third aspect, the scan converter comprises a colour converter configured to convert a colour indicated by the recognised colour change trigger into a predetermined combination of primary colour components. This enables pixels to be defined having the required primary colour components typically supported by a digital display device.

In an example according to this third aspect, the scan converter is configured to generate image data for displaying image elements with the indicated colour until such time as the colour change trigger detector recognises another colour change trigger.

In an example according to this third aspect, the colour change trigger detector is configured to operate in parallel with operation of the scan converter and to store, in a store accessible to the scan converter, a colour indicated when the colour change trigger detector recognises a colour change trigger.

According to a fourth aspect disclosed herein, there is provided an image generator configured to operate according to the method described above according the first aspect disclosed herein.

BRIEF DESCRIPTION OF THE DRAWINGS

Example embodiments of the present invention will now be described in more detail with reference to the accompanying drawings, of which.

DETAILED DESCRIPTION

Examples of the present invention will be described in the context of a typical application to upgrading components of a monochrome CRT-based display system to enable their use with digital colour displays. However, it will be clear that the principles embodied in such an application may be used more widely in any display system in which image elements are drawn cursively using combinations of x and y-direction deflection signals, for example.

Figure 1:
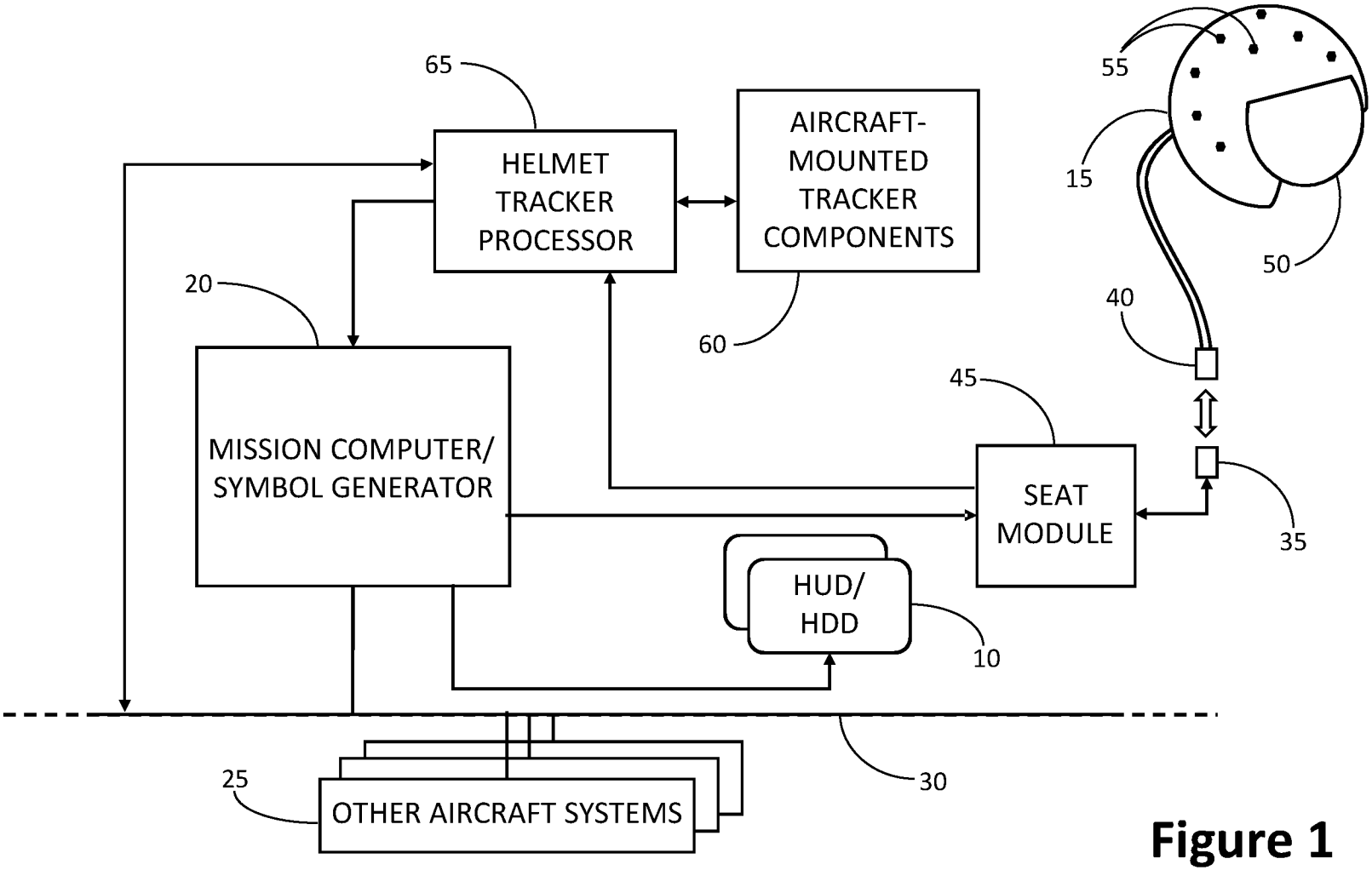
FIG. 1 is a block diagram showing the principal components in a known CRT-based helmet-mounted display system as may be used to implement example embodiments disclosed herein.
Figure 2:
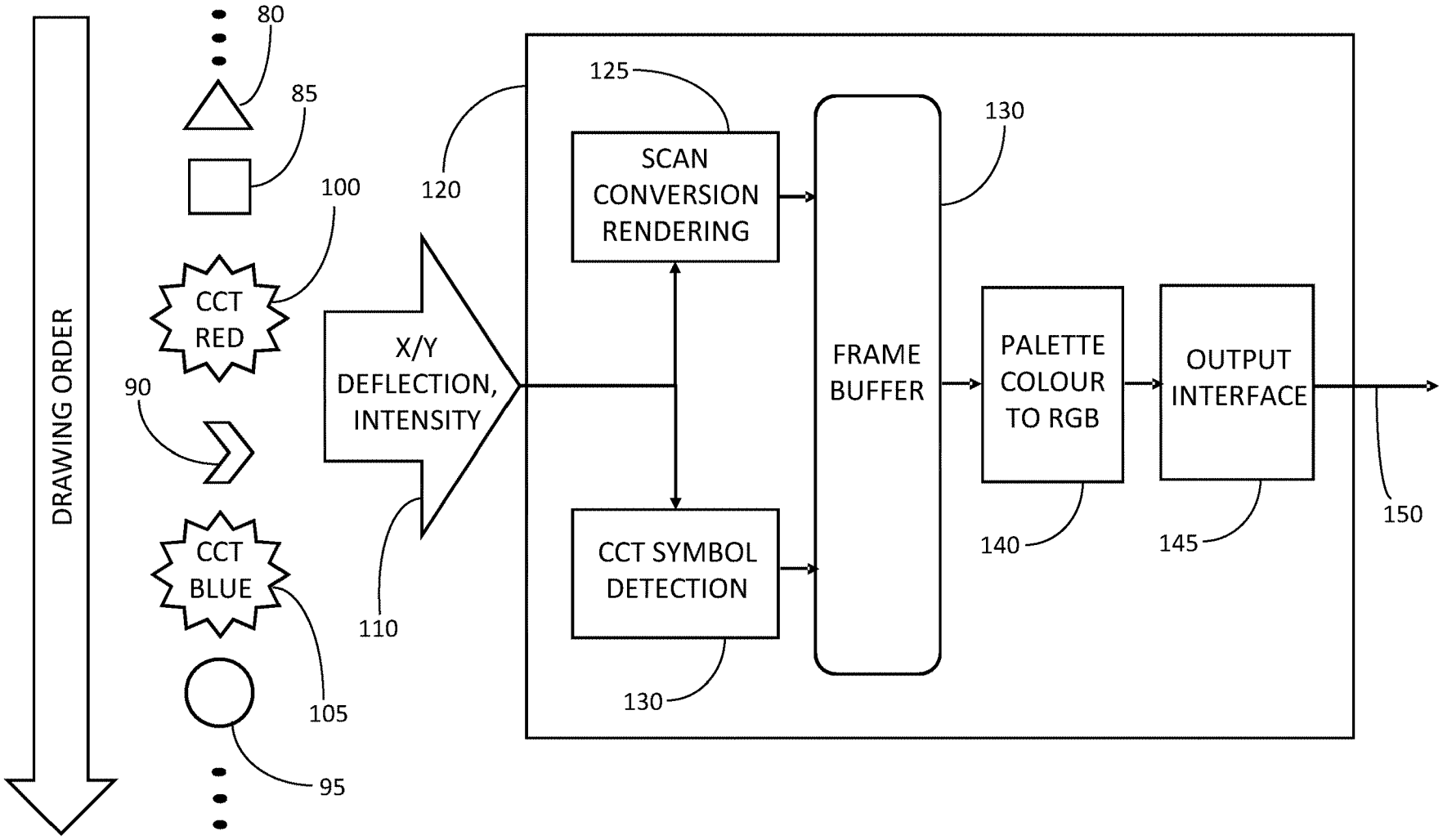
FIG. 2 is a functional block diagram showing how operation of the system of FIG. 1 may be changed according an example embodiment disclosed herein and how the resultant signals may be processed.

An example of a known aircraft display system, in particular for generating images for display on monochrome CRT-based helmet-mounted displays, will firstly be described in outline with reference to FIG. 1 to identify the principal components of such a system and their functionality. An example embodiment of the present invention will then be described in more detail with reference to FIG. 2, showing how operation of the system of FIG. 1 may be up-graded by the present invention to work with a digital helmet-mounted display system to display colour images.

Referring firstly to FIG. 1, there is shown a block diagram indicating the principle components of a known aircraft CRT-based display system. The display system is provided to generate images for display by a head-up display (HUD) or head-down display (HDD) 10 mounted in the aircraft or by a display mounted upon a helmet 15. The display system comprises a Mission Computer or dedicated Symbol Generator 20, arranged to output signals as required to generate image elements on any of the available displays. Those signals typically comprise high voltage x and y-direction deflection and video intensity signals for deflecting and controlling the intensity of an electron beam, in the case of a CRT-based display. Other display types may accept different signals representing deflections expressed as a combination of deflections along predefined axes.

The image elements 'drawn' by the deflecting beam typically comprise a combination of predefined symbols stored by the Symbol Generator 20, data provided by the Mission Computer and data provided by Other Aircraft Systems 25 over an aircraft data bus 30. The predefined symbols typically include lines, triangles, square or circles. The display is refreshed, i.e. the image elements are redrawn, at a frequency determined by the image refresh rate for the display. Typically, for a CRT-based avionic display, the image refresh rate is in the range of 50-60 Hz.

A CRT-based helmet-mounted display may be connected to receive the signals generated by the Symbol Generator 20 by means of a quick-release connector 35, 40 associated with a Seat Module 45, typically attached to a pilot's seat. The Seat Module 45 provides an interface for signals generated by the Symbol Generator 20 to enable the releasable attachment of pilot's or other flight crew's helmet-mounted CRT-based display when boarding and disembarking from the aircraft.

Images generated by the helmet-mounted CRT display may be projected onto the inside of a partially reflective helmet visor 50 acting as a combiner for the display. The helmet 15 also carries components of a helmet tracker system, for example LEDs 55 of an optical tracker system or inertial sensors (not shown in FIG. 1) of an inertial tracker system, or a combination of inertial and optical components in a hybrid helmet tracker system. The tracker system includes corresponding Aircraft-mounted Tracker Components 60, for example cameras at known fixed positions within the aircraft cockpit with a view of at least some of the LEDs 55 mounted upon the helmet 15, and an aircraft-mounted Helmet Tracker Processor 65 for calculating helmet orientation using sensor outputs. The Helmet Tracker Processor 65 supplies the calculated helmet orientation data to the Symbol Generator 20 and to other aircraft systems 25 over the data bus 30 for use whenever pilot line of sight information is required. The Seat Module 45 also provides an interface for signals passing between aircraft-mounted components 60, 65 and the helmet-mounted components 55 of the tracker system.

The aircraft display system represented in FIG. 1 is intended for use with monochrome CRT-based displays only. It would however be useful to be able to connect a modern digital display to the aircraft-mounted CRT-based display system components described above to display the images generated. In particular, it would be useful, through relatively minor changes to the functionality of the existing installed equipment, to be able to generate colour images for display by digital colour displays. Such an option would avoid a costly replacement of such installed equipment before the expiry of its normally expected lifetime and while its functionality remains relevant and useful.

The inventors in the present case have devised a technique for communicating colour information using the functionality available in an existing aircraft display system, for example the system shown in FIG. 1. The technique, as will now be described with reference to FIG. 1 and to FIG. 2, may be implemented by:

- an extension to the set of symbols that may be generated by the Symbol Generator 20;
- an extension to the functionality of the Symbol Generator 20; and
- addition of a 'Scan Conversion' module able to interpret the high voltage x and y-direction deflection signals received from the Symbol Generator 20 and to convert such signals into pixel-level colour image data for output to a digital colour display device.

Referring additionally to FIG. 2, an example stream of symbols is shown as may be drawn in a CRT display by signals output by the Symbol Generator 20, in an intended drawing order. The stream of symbols includes symbols 80, 85, 90, 95 of a conventional symbol set of the Symbol Generator 20, and some additional symbols 100, 105. Each of the additional symbols 100, 105 represents a 'colour change trigger' (CCT), a different one for each colour in a predefined palette of colours. In this example a RED CCT 100 and a BLUE CCT 105 are included in a stream of conventional symbols 80-95. Each CCT symbol may be drawn, if connected to a CRT-based display, using a respective combination of x and y-direction deflection and intensity signals 110 output by the Symbol Generator 20, as for any other conventional symbol. However, the intensity is set to 'off' for CCT symbols so that they would not be displayed. This ensures continuing compatibility with CRT displays if required. The number of different CCT symbols included in the symbol set of the Symbol Generator 20 is determined by the number of colours to be included in the palette of colours.

The Symbol Generator 20 is also provided with an extension to its interface with the Mission Computer or with other aircraft systems 25 to enable them to specify particular colours from the available palette of colours when instructing the Symbol Generator 20 to generate elements of an image. For example, if a graphics command set, such as a subset of OpenGL, is supported by the Symbol Generator 20, its functionality may be extended to include support for commands defining a colour.

For example, if a navigation system of the aircraft requires a predefined direction indicator symbol 90 to be displayed in red, it may specify the colour 'red' in a command when communicating with the Symbol Generator 20. On receipt of such a command, the upgraded Symbol Generator 20 selects the predefined 'Red' CCT symbol 100 from the extended symbol set and outputs respective x and y-direction deflection and intensity signals 110 to 'draw' that symbol 100 before or, optionally, after outputting signals 110 to draw the lines of the direction indicator symbol 90.

A Scan Conversion Module 120 is provided to receive the signals 110 and to implement four functions:

(1) to determine which pixels in the image area of a digital display device are to be activated or de-activated to display symbols according to received x and y-direction deflection and intensity signals 110;

(2) to generate pixel-level digital image data at an appropriate image refresh rate for output to a digital display device;

(3) to detect and recognise a CCT symbol when corresponding combinations of x and y-direction deflection signals 110 are received from the Symbol Generator 20; and (4) to set a respective colour for pixels when generating digital image data to display symbols represented in signals 110 received after detection of the CCT symbol.

To achieve functions (1) and (2) above, the Scan Conversion module 120 includes a Scan Conversion Rendering module 125 arranged to receive the signals 110 representing conventional symbols 80-95 for display and to determine which pixels are to be activated in the image area of a digital display device to display those symbols. Pixel-level image data are generated for each image refresh period of the digital display device. The generated image data are stored in a Frame Buffer 130 or other memory. Those pixels not used in the display of symbols for that image refresh period are set to the background state for the display, e.g. black.

To achieve functions (3) and (4) above, the Scan Conversion module 120 includes a Colour Change Trigger (CCT) Symbol Detection module 130 arranged to detect and recognise signals 110 representing a CCT symbol 100, 105. Having determined which of the possible CCT symbols has been generated, it stores an indicator of the colour, from the available palette of colours, to be used to display either an immediately preceding symbol 80-95 or one or more subsequently received symbols 80-95 from the conventional symbol set. The stored colour indicator is used by the Scan Conversion Rendering module 125 when generating the pixel-level image data, adding the colour indicator for those pixels selected to display the associated symbol. The colour indicator may be initialised to a default colour, e.g. green, pending the detection of a CCT symbol 100, 105 specifying a different colour to use.

Having assembled and stored image data for a current image refresh period or 'frame' in the Frame Buffer 130, a Palette Colour to RGB module 140 converts the stored image data and their associated palette colour indications into corresponding Red/Green/Blue (RGB) image data for each pixel to be used to control a digital colour display device. The combination of red, green and blue illumination levels required to display a pixel with the indicated palette colour is predefined for each of the colours in the palette.

The Palette Colour to RGB module 140 outputs the RGB image data for the current image refresh period/frame to an Output Interface component 145 arranged to output (150) the RGB image data in a form required by a particular display device.

The Scan Conversion Rendering module 125 may optionally reset the colour indicator to the default colour in readiness for signals 110 applicable to a next image refresh period/frame. Alternatively, the colour indicator may remain at the most recently indicated palette colour pending the receipt of another CCT symbol from the Symbol Generator 20, according to a predetermined policy for a respective application of the invention.

A more rapid response to received x and y-direction deflection and brightness on/off signals may be achieved if the Scan Conversion module 120 is arranged to output digital image data as soon as possible after receipt of signals 110 from the Symbol Generator 20. This enables a digital display device to begin displaying elements of symbols as they're drawn, more rapidly than the nominal image refresh period or frame rate. Various methods are known for achieving such improvements in display response in digital displays while also achieving the required perceived brightness and colour levels of the pixels involved and will not be discussed here in further detail.

Operation of the CCT Symbol Detection component 130 will now be discussed in more detail with reference to FIG. 3, designed to operate with an example set of CCT symbols as may be represented in signals 110 output by the upgraded Symbol Generator 20 discussed above.

Figure 3A:
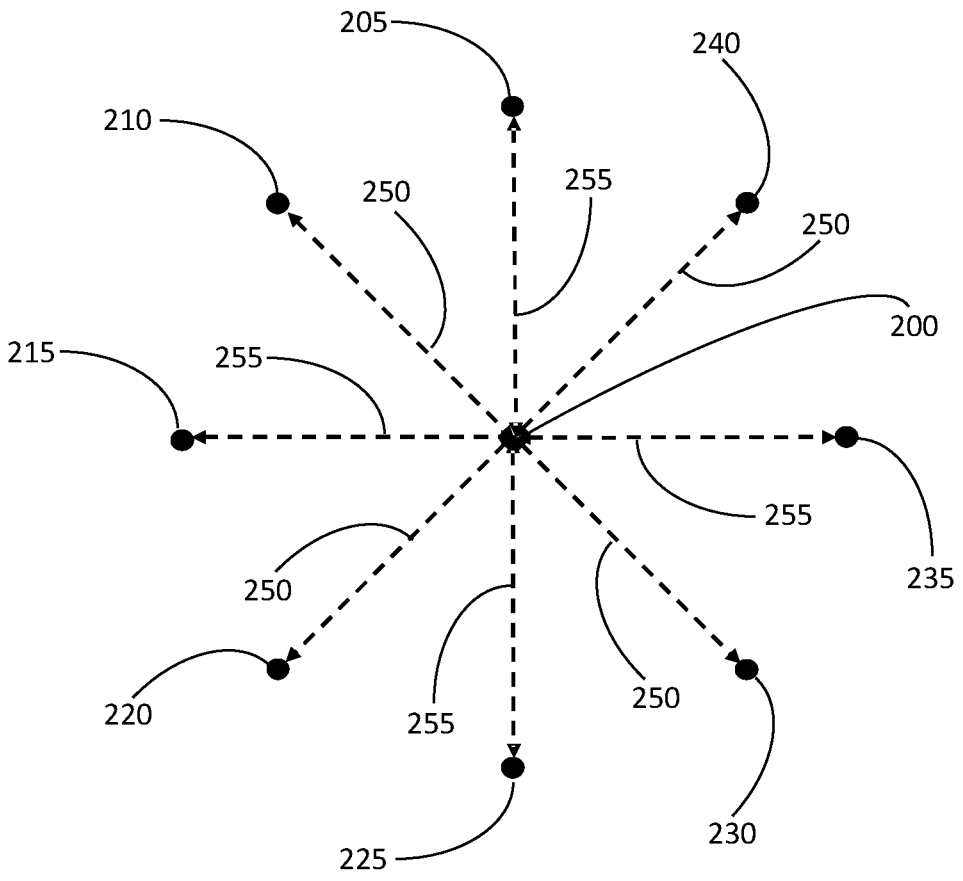
FIG. 3 shows an example set of colour change trigger (CCT) symbols and their characterising features as may be generated through changes to the system of FIG. 1 according to example embodiments disclosed herein.

Referring to FIG. 3*a*, each CCT symbol is designed to result in a different combination of x and y-direction deflection signals 110 being output by the Symbol Generator 20; different to signals for any of the conventional symbols 80-95 in the symbol set. In the examples to be described, each CCT symbol may be recognised by a respective combination of x and y-direction deflection signals moving a notional image 'spot' between a start position 200 and points selected from eight points 205, 210, 215, 220, 225, 230, 235, 240, each a predetermined distance along one of eight different angularly separated directions or 'arms' extending from the start position 200. Each CCT symbol is distinguished by a different pair of return deflections (arms) between the start position 200 and two points selected from the eight points 205, 210, 215, 220, 225, 230, 235, and 240.

The start position 200 is intended to be a current spot position, as if outputting to a conventional CRT display. This minimises the drawing time overhead associated with drawing CCT symbols as compared with an alternative of moving the spot to a predetermined start position 200 in the display area of the display device for drawing CCT symbols, for example a point near to a side of the display area not normally used for displaying symbols.

The Symbol Generator 20 is arranged, before outputting signals for a particular CCT symbol, to output an identifying sequence of deflections common to all CCT symbols. The initial deflection sequence is intended to be distinguishable from deflections likely to be required for any of the non-CCT symbols in the conventional symbol set and to be detectable by the CCT Symbol Detection module 130. In one example, the initial deflection sequence comprises two return deflections between the start position 200 and the point 205 shown in FIG. 3*a*. That is, the initial deflection sequence comprises a sequence of three 180° 'U'-turns. There would be no reason when displaying symbols from the conventional symbol set to make two return deflections between the same two points 200, 205. The CCT Symbol Detection module 130 is arranged to recognise this initial deflection sequence as being an indication that the signals that follow represent one of the predetermined CCT symbols. Other initial deflection sequences may be envisaged for the purpose of indicating that one of the CCT symbols is about to be generated by the Symbol Generator 20.

An example CCT symbol set will now be described, each CCT symbol comprising a distinct combination of a first and a second set of return deflections between the start position 200 and a different one of the eight points 205-240 shown in FIG. 3*a*. Having two sets of deflections and eight different points to choose from provides for sixteen different CCT symbols, as will now be described with reference to FIG. 3*b*.

Figure 3B:
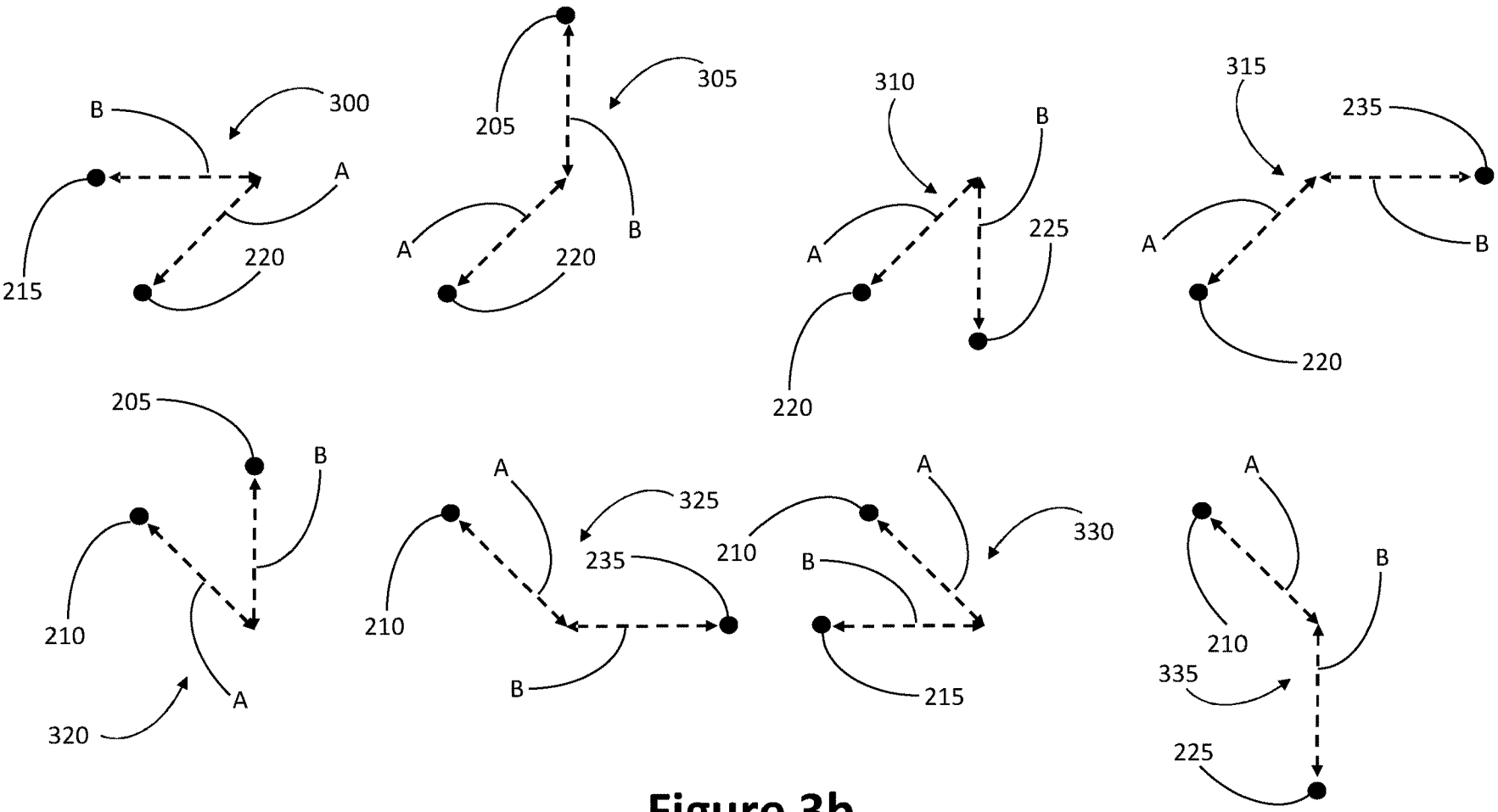

Referring to FIG. 3*b*, sixteen distinct CCT symbols 300-375 are shown. For each CCT symbol, the first set of deflections comprise a return set of deflection signals, labelled 'A', along one of the four 'diagonal' directions 250 between the start position 200 and the points 210, 220, 230 and 240 of FIG. 3*a*. The second set of deflections comprise a return set of deflection signals, labelled CB', along one of the four 'rectangular' directions 255 between the start position 200 and the points 205, 215, 225 and 235.

In principle, such a combination of first and second return deflections along different directions provides a greater chance for the CCT Symbol Detection module 130 to distinguish one CCT symbol from another. This is an important consideration, for example if images are pre-distorted by the Symbol Generator 20 to take account of distortions due to optics of a display, for example curvature of a visor 50 of a helmet-mounted display system. Such pre-distortion of symbols may result in a different angle between the directions of the first and second sets of deflections to that expected by reference to FIG. 3*b*. The extent of pre-applied distortion will typically vary over the available image area and so according to the current position 200 from which the Symbol Generator 20 is intending that a symbol be drawn.

In an example implementation mentioned above, a fixed start position 200 may be chosen for all CCT symbols. This would ensure that the same pre-distortion is applied to all CCT symbols. However, having a fixed start position 200 would incur a time penalty in the Symbol Generator 20 in generating additional x and y-direction deflection signals to move the 'spot' to the fixed start position 200 every time a CCT symbol is to be generated. Such a time penalty may be tolerable in some applications and may provide an added advantage in enabling more complex and hence a greater number of different CCT symbols to be reliably recognised following pre-distortion.

To take account of possible variations in the observed directions of the first and second sets of return deflection signals, the CCT Symbol Detection module 130 is arranged to apply a predetermined tolerance when correlating an observed combination of deflection directions with one of the expected combinations of deflection directions indicated in FIG. 3.

Further extensions in complexity may in principle be introduced into the design of CCT symbols, making use of two or more sets of deflection signals, as would be apparent to the notional skilled person. An increase in complexity would enable a larger number of CCT symbols to be generated, providing for a greater number of colours in the colour palette. The symbols shown in FIG. 3*b* embody a constraint requiring that the first set of return deflections follow one of the four 'diagonal' directions 250 and that the second set of return deflections follow one of the four 'rectangular' directions 255. Relaxing that constraint would in principle provide for up to 64 different CCT symbols if all eight possible directions 250, 255 were available to each of the first and second sets of return deflections. Alternatively, inclusion of a third set of deflection signals and/or inclusion of a further subdivision of the available directions for deflection about a current start position 200 would in principle provide for a yet greater number of combinations.

However, increasing the complexity of the CCT symbols not only increases the time required to generate and to detect such symbols, but it may also renders such symbols less distinctive. A colour palette of sixteen colours with sixteen CCT symbols 300-375 as shown in FIG. 3*b*, has been found to provide an acceptable compromise in typical helmet-mounted display systems. The number of CCT symbols appears to provide a good balance between the number of possible colours and the reliable and timely generation and detection of CCT symbols. In particular, the described choice of CCT symbols in FIG. 3*b* provides the following advantages:

a) The Symbol Generator 20 requires nominally the same time to draw each CCT symbol, enabling a drawing time cycle to be determined independently of colour chosen;

b) Each of the deflections required to draw an 'arm' of a CCT symbol is of the same length and relatively small, so reducing the drawing time overhead and reducing disturbance to a deflection drive circuit in the Symbol Generator 20;

c) The CCT symbols are roll angle-invariant. That is, the CCT symbols are distinguished only by the angles between the initial deflection sequence of CCT symbols and first and second drawn 'arms' of the symbols;

d) The CCT symbols are recognisable by the CCT Symbol Detection module 130 in the presence of noise and other distortions, including the above-mentioned display distortion correction; and e) The drawing of CCT symbols begins and ends at the same position. This enables the CCT symbols to be inserted between or inside other symbols without impact on the surrounding drawing.

The CCT Symbol Detection module 130 may be implemented in one several different ways, using one of a number of possible variants of data processing capability and CCT symbol recognition methodology as would be apparent to a person of ordinary skill in the relevant art when made aware of the principles described herein. For the data processing capability, the module 130 may comprise for example a digital processor executing software, or a combination of one or more configurable hardware logic devices and a digital processor to implement a CCT symbol detection method to be described below.

In one example of a method implemented by the CCT Symbol Detection module 130 for recognising CCT symbols, the module 130 operates a continuous process, in parallel with the operation of the Scan Conversion Rendering module 125, of detecting and digitising the deflection voltages represented in the received x and y-direction deflection signals 110. The digitisation process forms a sequence of pairs of numerical values regularly spaced in time according to the sampling frequency of the digitisation process, each pair representing the x and y-direction deflection voltages or currents detected at a respective moment in time. The module 130 uses the resultant pairs of x and y-direction deflection voltages or currents to construct a sequence of overlapping 'micro' deflection vectors. That is, a sequence of vectors are formed linking a point represented by a first pair of deflection voltages or currents to a point represented by a pair of voltages or currents two later than the first, for example, in a continuous process. Each 'micro' vector therefore represents, in this example, a local deflection direction determined over two sampling periods of the digitisation process. The overlap of the vectors acts as a noise filter. Vectors may alternatively be formed over three or more sampling periods according to the frequency of the digitisation process, the extent of vector overlap required and the density of results required by later processing. The sequence of deflection vectors is passed through a filter.

If the vectors had been formed between adjacent points determined by the digitisation process, then any instantaneous sample noise would have had a very significant and undesirable impact on the vector directions when calculated.

A continuous sequence of pairs of first and second deflection vectors is selected by the module 130 from the sequence of vectors; the first vector in a pair being separated in time from the second vector in the pair by the time expected to be taken by the Symbol Generator 20 to draw one of the 'arms' A, B of a CCT symbol. The angle between the vectors in each pair is calculated to result in a corresponding sequence of calculated angles.

Some angles expected to arise when drawing a CCT symbol are known, in particular the 180° 'U'-turn at the end of each arm when drawing the initial CCT symbol deflection sequence. The CCT Symbol Detection module 130 is arranged to detect in the received sequence of calculated angles a pattern of (e.g. three) 180° 'U'-turns of the initial CCT symbol deflection sequence. Upon detecting such a pattern the module 130 extracts from the sequence of calculated angles, based upon the expected timings for drawing CCT symbols, the subsequently received angle between the final 'arm' of the initial deflection sequence and the first 'arm' A of a CCT symbol drawn by the first deflection sequence and then the angle between the first 'arm' A of the CCT symbol and the second 'arm' B drawn by the second deflection sequence. The two extracted angles are then correlated with the angles expected for a particular CCT symbol to determine which of the sixteen CCT symbols 300-375 shown in FIG. 3*b* has been drawn by the Symbol Generator 20. The indicated colour is thereby known shortly after the CCT symbol has been drawn. The colour indicator for the respective palette colour may then be set for use by the Scan Conversion Rendering module 125.

In a variation to the technique described above for detecting CCT symbols, account may be taken of the possibility that, due to the way the Symbol Generator 20 operates, the drawing time of the arms of a CCT symbol may vary slightly according to the angle at which the arm is drawn by generated x and y-direction deflection signals 110. That is, the time taken by the Symbol Generator 20 to draw one of the arms 210, 220, 230 or 240 shown in FIG. 3*a* may require a slightly different drawing time to that of one of the arms 205, 215, 225 or 235, even though the lengths of all the arms are intended to be identical. This results in some 'jitter' in the overall drawing time of a CCT symbol. The result is that, in the above technique, the selection of pairs of vectors separated by a fixed time period may become mis-aligned with the actual drawing time of the Symbol Generator 20 and, in particular, with the timing of key changes in drawing direction. This reduces the reliability of detection or recognition of a CCT symbol.

Therefore, in a variation to the above technique, the CCT Symbol Detection module 130 is arranged to monitor the direction of the overlapping micro-vectors to detect when key changes of direction expected in a CCT symbol actually occur, for example a 180° 'U'-turn. The timing of such a detected change in direction may be used to re-align the detection points relied upon to extract the relative angles of the arms 'A' and 'B'. For example, the pairs of vectors selected for revealing the angle between the arms 'A' and 'B', following detection of the initial deflection sequence of a CCT symbol, may be adjusted relative to the timing of detection of the initial deflection sequence or the timing of detection of a first 180° 'U'-turn at the end of arm 'A'. The allowable timing adjustment may be limited to avoid false recognition of a CCT symbol. By this variation in the above-described technique, the reliability of detection and recognition of CCT symbols may be increased in the presence of drawing time jitter.

Other techniques for analysing the received x and y-direction deflection signals 110 would be apparent to the notional skilled person to enable CCT symbols to be detected and recognised.

The Scan Conversion module 120 may be implemented using a combination of configurable logic devices such as field-programmable gate array (FPGA) devices and software executing on a digital processor. Any data storage devices used for storage of data, for example to implement the Frame Buffer 130, may be implemented using a combination of one or more separate memory devices and memory associated with the data processing devices, such as cache memory. Received x and y-direction deflection signals 110 may be measured using known voltage sensing devices or by analogue-to-digital conversion devices and the resultant data may be input to the data processing elements of the CCT Symbol Detection module 130 for analysis, as described above.

The examples to be included within the scope of the claims that follow include variations to the methods described above as would be apparent to the notional skilled person on being made aware of the techniques and principles described herein. In particular, variations in the implementation of the Scan Conversion Rendering module 125 and the generation of pixel-level image data of the required colour from received x and y-direction deflection signals 110, as would be apparent to the notional skilled person, are intended to fall within the scope of the claims.

It will be understood that the data processor or data processing system or circuitry referred to herein may in practice be provided by a single chip or integrated circuit or plural chips or integrated circuits, optionally provided as a chipset, an application-specific integrated circuit (ASIC), field-programmable gate array (FPGA), digital signal processor (DSP), graphics processing units (GPUs), etc. The chip or chips may comprise circuitry (as well as possibly firmware) for embodying at least one or more of a data processor or processors or a digital signal processor or processors which are configurable so as to operate in accordance with the exemplary embodiments. In this regard, the exemplary embodiments may be implemented at least in part by computer software stored in (non-transitory) memory and executable by the processor, or by hardware, or by a combination of tangibly stored software and hardware (and tangibly stored firmware).

Where reference is made herein to memory unit for storing data, this may be provided by a single device or by plural devices. Suitable devices include for example a hard disk and volatile or non-volatile semiconductor memory.

Although at least some aspects of the embodiments described herein with reference to the drawings comprise computer processes performed in processing systems or processors, the invention also extends to computer programs, particularly computer programs on or in a carrier, adapted for putting the invention into practice. The program may be in the form of non-transitory source code, object code, a code intermediate source and object code such as in partially compiled form, or in any other non-transitory form suitable for use in the implementation of processes according to the invention. The carrier may be any entity or device capable of carrying the program. For example, the carrier may comprise a storage medium, such as a solid-state drive (SSD) or other semiconductor-based RAM; a ROM, for example a CD ROM or a semiconductor ROM; a magnetic recording medium; optical memory devices in general; etc.

The examples described herein are to be understood as illustrative examples of embodiments of the invention. Further embodiments and examples are envisaged. Any feature described in relation to any one example or embodiment may be used alone or in combination with other features. In addition, any feature described in relation to any one example or embodiment may also be used in combination with one or more features of any other of the examples or embodiments, or any combination of any other of the examples or embodiments. Furthermore, equivalents and modifications not described herein but which would be apparent to a person or ordinary skill in the relevant art, may also be employed within the scope of the invention, which is defined in the claims.

The invention claimed is:

1. A method for operating an image generator, arranged to generate and to output signals for displaying image elements of a predefined set of image elements, each image element being defined by respective varying deflection signals, the method comprising:

defining a colour change trigger, the colour change trigger comprising an additional image element defined by varying deflection signals different to varying deflection signals of an image element of the predefined set; and generating and outputting the varying deflection signals of the defined colour change trigger thereby to indicate a respective colour for use in displaying an image element of the predefined set.

2. The method according to claim 1, wherein the varying deflection signals defining the colour change trigger image element comprise an initial sequence of varying deflection signals followed by signals representing a combination of at least a first set of return deflections along a first direction and a second set of return deflections along a second direction, different to the first direction.

3. The method according to claim 2, wherein the initial sequence of varying deflection signals represent deflections between a start position and a second position including three changes of direction each of approximately 180°.

4. The method according to claim 2, comprising outputting a signal to indicate that the colour change trigger image element is not to be displayed.

5. The method according to claim 2, comprising outputting varying deflection signals representing a colour change trigger image element before outputting varying deflection signals representing an image element of the predefined set thereby to indicate that the image element of the predefined set is to be displayed with the colour indicated by the preceding colour change trigger image element.

6. The method according to claim 2, comprising defining a plurality of colour change trigger image elements, each colour change trigger image element represented by different varying deflection signals and each indicating a different colour in a predefined palette of colours, and wherein the varying deflection signals comprise varying x and y-direction deflection voltages or currents.

7. The method according to claim 1, comprising outputting a signal to indicate that the colour change trigger image element is not to be displayed.

8. The method according to claim 1, comprising outputting varying deflection signals representing a colour change trigger image element before outputting varying deflection signals representing an image element of the predefined set thereby to indicate that the image element of the predefined set is to be displayed with the colour indicated by the preceding colour change trigger image element.

9. The method according to claim 1, comprising defining a plurality of colour change trigger image elements, each colour change trigger image element represented by different varying deflection signals and each indicating a different colour in a predefined palette of colours.

10. The method according to claim 9, wherein each of the plurality of colour change trigger image elements is arranged such that the time period required for the signal generator to output the varying deflection signals for each of the plurality of colour change trigger image elements is nominally the same.

11. The method according to claim 1, wherein the varying deflection signals comprise varying x and y-direction deflection voltages or currents.

12. A method for generating digital colour image data for a digital display using output by an image generator arranged to generate and to output signals for displaying image elements of a predefined set of image elements, each image element being defined by respective varying deflection signals, the image generator configured to define a colour change trigger, the colour change trigger comprising an additional image element defined by varying deflection signals different to varying deflection signals of an image element of the predefined set, and the image generator further configured to generate and output the varying deflection signals of the defined colour change trigger thereby to indicate a respective colour for use in displaying an image element of the predefined set, the method comprising:

receiving varying deflection signals output by the image generator;

determining the deflection directions represented by the received varying deflection signals;

recognising, from selected combinations of the determined deflection directions, a respective colour change trigger, thereby to determine a colour indicated by the recognised colour change trigger; and converting the received varying deflection signals into image data defining pixels in a digital display device for displaying a respective image element with the indicated colour.

13. The method according to claim 12 wherein, the selected combination of determined deflection directions comprise pairs of deflection directions determined at times separated by an expected time to receive varying deflection signals defining one component of a colour change trigger.

14. An image generator arranged to generate and to output signals for displaying image elements of a predefined set of image elements, each image element being defined by respective varying deflection signals, the image generator configured to:

define a colour change trigger, the colour change trigger comprising an additional image element defined by varying deflection signals different to varying deflection signals of an image element of the predefined set and generate and output the varying deflection signals of the defined colour change trigger thereby to indicate a respective colour for use in displaying an image element of the predefined set.

15. A display system comprising:

an image generator according to claim 14;

a colour change trigger detector configured to determine deflection directions represented by varying deflection signals received from the image generator and, using selected combinations of the determined deflection directions, to recognise a respective colour change trigger thereby to determine a colour indicated by the recognised colour change trigger; and a scan converter configured to convert varying deflection signals received from the image generator into image data defining pixels in a digital display device for displaying a respective image element with the indicated colour.

16. The display system according to claim 15, wherein the colour change trigger detector is configured to operate in parallel with operation of the scan converter and to store, in a store accessible to the scan converter, a colour indicated when the colour change trigger detector recognises a colour change trigger.

17. The display system according to claim 15, wherein the scan converter comprises a colour converter configured to convert a colour indicated by the recognised colour change trigger into a predetermined combination of primary colour components.

18. The display system according to claim 17, wherein the scan converter is configured to generate image data for displaying image elements with the indicated colour until such time as the colour change trigger detector recognises another colour change trigger.

19. The display system according to claim 17, wherein the colour change trigger detector is configured to operate in parallel with operation of the scan converter and to store, in a store accessible to the scan converter, a colour indicated when the colour change trigger detector recognises a colour change trigger.

20. The display system according to claim 15, wherein the scan converter is configured to generate image data for displaying image elements with the indicated colour until such time as the colour change trigger detector recognises another colour change trigger.

* * * * *